US005430417A

United States Patent [19]

Martin et al.

[11] Patent Number: 5,430,417

[45] Date of Patent: Jul. 4, 1995

[54] TUNABLE MATCHING NETWORK

[75] Inventors: Siegbert Martin, Backnang; Erich Pivit, Allmersbach, both of Germany

[73] Assignee: AFT Advanced Ferrite Technology GmbH, Backnang, Germany

[21] Appl. No.: 182,209

[22] PCT Filed: May 23, 1992

[86] PCT No.: PCT/DE92/00420

§ 371 Date: Jan. 4, 1994

§ 102(e) Date: Jan. 4, 1994

[87] PCT Pub. No.: WO93/01627

PCT Pub. Date: Jan. 21, 1993

[30] Foreign Application Priority Data

Jul. 5, 1991 [DE] Germany ..... 41 22 290.3

[51] Int. Cl.[6] ..... H01P 5/04

[52] U.S. Cl. ..... 333/33; 333/24.1; 333/263

[58] Field of Search ..... 333/33, 24.1, 263, 99 PL

[56] References Cited

U.S. PATENT DOCUMENTS

| | | | |
|---|---|---|---|
| 2,403,252 | 7/1946 | Wheeler . | |
| 3,384,841 | 5/1968 | Di Piazza | 333/160 |
| 3,681,716 | 8/1972 | Chiron et al. . | |
| 3,745,488 | 7/1973 | Rogers | 333/33 |
| 3,792,385 | 2/1974 | Napoli et al. . | |
| 4,754,229 | 6/1988 | Kawakami et al. | 333/33 X |
| 5,065,118 | 11/1991 | Collins et al. | 333/33 |

FOREIGN PATENT DOCUMENTS 55-096701 10/1980 Japan .

OTHER PUBLICATIONS

IRE Transactions on Microwave Theory and Techniques. vol. 7, No. 2, Apr. 1959, New York US, pp. 296–297. C. E. Muehe: "Quarter-wave compensation of resonant discontinuities".

F. Durodie: New Antenna Impedance Evaluation and Matching Tools for Textor's ICRH System, at the 16th Symposiom on Fusion Technology (SOFT), London, Sep. 3–7, 1990.

*Primary Examiner*—Paul Gensler

*Attorney, Agent, or Firm*—Spencer, Frank & Schneider

[57] ABSTRACT

A matching network is to be provided which can quickly and easily be tuned to a desired impedance. The matching network has a first and a second line which are interconnected at one end, while their other ends are coupled to a microwave line, and a third line which branches off from the interconnection of the other two lines. The first and/or second line and the third line are loaded with ferrite. The ferrite of the first and/or second line and that of the third line are exposed to separate magnetic fields which can be varied independently of each other.

7 Claims, 2 Drawing Sheets

TUNABLE MATCHING NETWORK

BACKGROUND OF THE INVENTION

1. Field of the Invention

The present invention relates to a tunable matching network which may be coupled to a microwave transmission line.

2. Brief Description of the Related Art

As indicated in a presentation by F. Durodie on New Antenna Impedance Evaluation and Matching Tools for TEXTORS's ICRH System, at the 16th Symposium on Fusion Technology (SOFT), London, Sep. 3–7, 1990, a tunable matching network, is required, for example, for a microwave transmission line which couples high power microwave energy into the plasma combustion chamber of a fusion reactor. Since the plasma combustion chamber represents a constantly changing load resistance to the microwave transmission line and in order for the generator generating the microwave energy not to be damaged by reflections which are the result of a mismatch, each occurring load resistance must be transformed to the characteristic impedance of the line. According to the mentioned publication, two tunable capacitors which are separated from one another by the length of a transformation line, which must be measured precisely, are coupled to the microwave transmission line for this purpose. Tuning of the capacitors is the result of a mechanically elaborate pneumatic device. However, since the load resistance may change very rapidly, this arrangement would be too slow to bring about matching that is as free of delay as possible.

A tunable matching network may not only be used in the case described, but at any time a changing resistance impedance is switched on to a microwave transmission line.

SUMMARY OF THE INVENTION

It is the object of the invention to provide a matching network which may be rapidly tuned to a desired impedance at low expense.

According to the invention, this object is attained by a tunable matching network having first and second lines each having a first and a second end, the first ends of the first and second lines being connected together and the second ends of the first and second lines each being adapted for coupling to a microwave transmission line, and at least one of the first and second lines being loaded with ferrite material, a third line having one end coupled to and branching off from the first ends of the first and second lines and being loaded with the ferrite material, and means for generating and exposing the ferrite material of the first and second lines and the ferrite material of the third line to separate magnetic fields which are independently chargeable for turning the matching network.

Due to the fact that the matching network may be tuned electrically without any mechanically movable parts, impedance matching that is free of delay is ensured when the load resistance of the microwave transmission line changes rapidly.

A further advantage of the arrangement is that no transformation line is required between the two variable reactances of the matching network mentioned above.

BRIEF DESCRIPTION OF THE DRAWINGS

The invention is further elucidated by means of an embodiment shown in the drawing in which.

DETAILED DESCRIPTION OF THE PREFERRED EMBODIMENT

Figure 1:
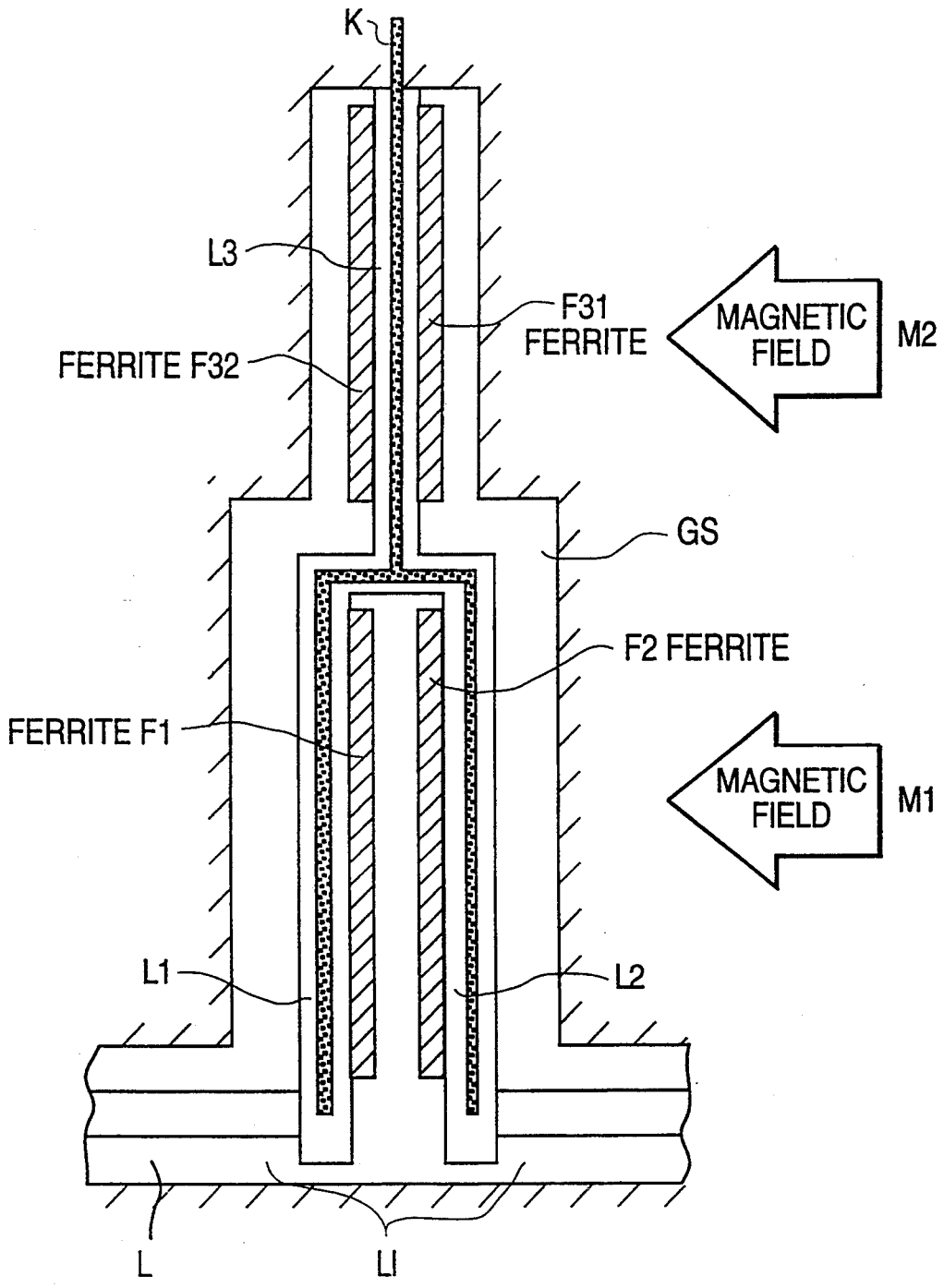
FIG. 1 is a longitudinal view of a matching network.
Figure 2:
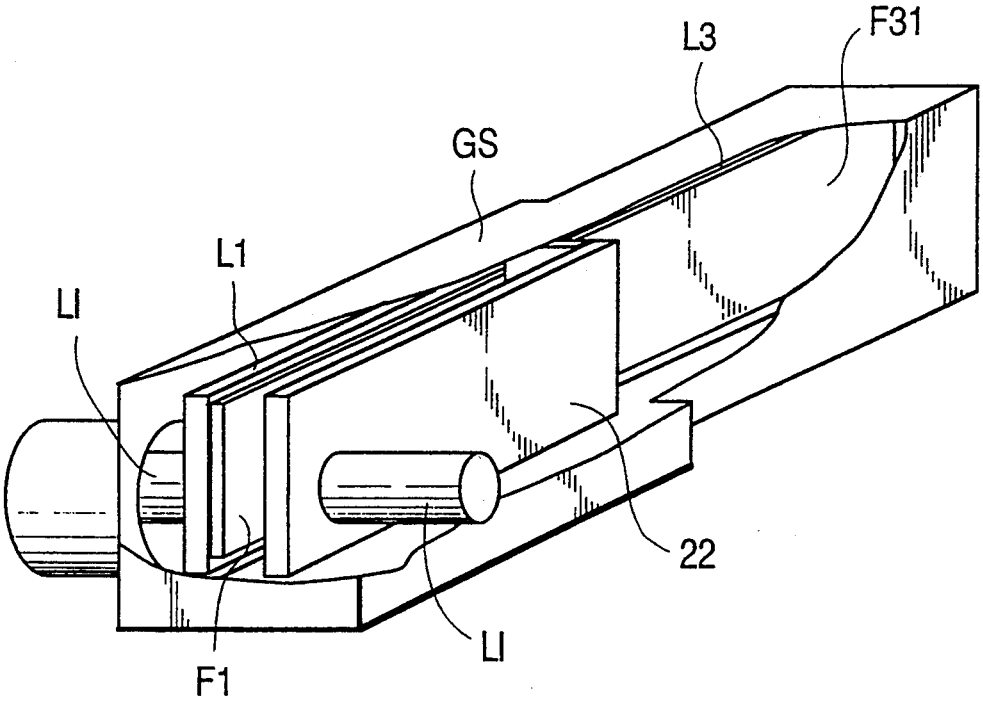
FIG. 2 is a perspective illustration of the same.
Figure 3:
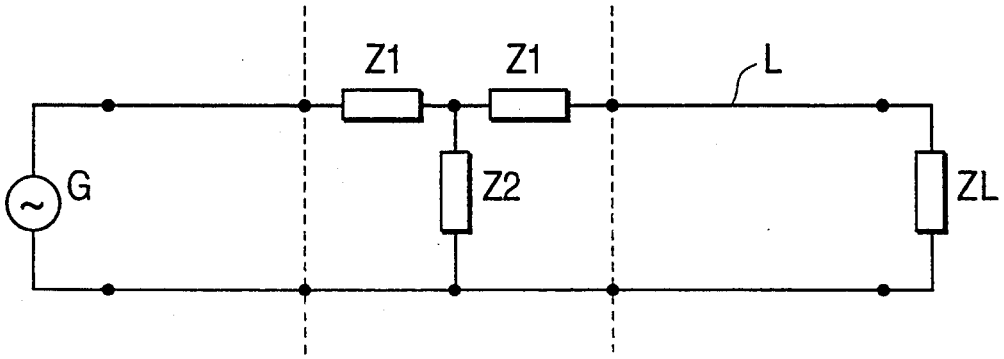
FIG. 3 is an equivalent circuit diagram of this matching network.

FIG. 1 is a longitudinal section and FIG. 2 is a perspective illustration of a tunable matching network, which is coupled to a microwave transmission line L. In the illustrated embodiment, the microwave transmission line L is a coaxial line having an inner conductor LI. As already mentioned in the introduction, and as illustrated by the equivalent circuit diagram in FIG. 3, the microwave transmission line L is fed at its input by a generator G and is terminated at its opposite output by means of a changing load resistance ZL. The T-equivalent circuit diagram which includes impedances Z1 and Z2, and which is inserted into the microwave transmission line L, represents the matching network, which serves to transform the respective load resistance ZL to the characteristic impedance of the line.

The matching network has a first line L1 and a second line L2, each of which contacts with one end of the interrupted inner conductor LI of the coaxial microwave transmission line L. At the opposite end, the two lines L1 and L2 are connected to one another. A third line L3 branches off from this connecting point. In the embodiment shown in FIGS. 1 and 2, lines L1, L2 and L3 are configured as strip conductors. The outer conductor to the strip conductors L1, L2 and L3 is formed by the housing GS, which is indicated by hatching and which is connected to the outer conductor of the coaxial microwave transmission line L. In the shown embodiment, the plate-shaped inner conductors of the two strip lines L1 and L2 are coated with ferrite layers F1 and F2 on adjacent faces. In the third line L3, the plate-shaped inner conductor is coated on both sides with ferrite layers F31 and F32. Instead of applying ferrite layers F1, F2, F31, F32 to the inner conductors, the outer conductor GS of the three lines may be also coated with ferrite. The same applies also if lines L1, L2 and L3 are realized as coaxial lines. The arrows drawn in FIG. 1 outside the matching network indicate that the two lines L1 and L2 are exposed to a magnetic field M1, and separated from this, the third line L3 is exposed to a magnetic field M2. What is involved are magnetic fields M1 and M2 which can be changed independently of one another. With the magnetic field M1 acting on lines L1 and L2, the electrical length of these two lines L1 and L2 may be varied. Independently of this, the electrical length of the third line L3 may be varied by means of the changeable magnetic field M2 which influences ferrites F31 and F32.

The described arrangement of lines L1, L2 and L3 actually represents two different networks. The one network comprising the first line L1 and second line L2, together with the housing GS, forms a shielded two-wire line in which two modes exist, an in-phase mode and a push-pull mode. The push-pull mode is present if the currents flowing in lines L1 and L2 are equally strong and flow in opposite directions, and the in-phase mode is present if the currents flowing in lines L1 and L2 are equally strong and directed in the same direction.

In the second network, comprising line L3 and the housing GS, only the in-phase mode is able to propagate. The ferrite material on lines L1 and L2 is arranged between the lines (see FIG. 1) and thus is only effective for the push-pull mode. The push-pull impedance Zg of lines L1, L2 is tuned by means of magnetic field M1, and the in-phase impedance Zs of line L3 by means of magnetic field M2.

The impedances Z1 and Z2 indicated in the equivalent circuit diagram (see FIG. 3) of the matching network then have the following relationship to the in-phase impedance $Z_s$ and to the push-pull impedance $Z_g$:

$$Z1 = Z_g$$

$$Z2 = \frac{Z_s - Z_g}{2}$$

In case the matching network is operated at very high power, it is advisable to cool lines L1, L2 and L3. The heat generated in ferrites F1, F2, F31 and F32 can be dissipated very effectively and in a simple manner with the help of cooling channels that pass through the inner conductor and/or the outer conductor of lines L1, L2 and L3 which are configured as strip lines or coaxial lines. FIG. 1 indicates a cooling channel designated K.

The changeable magnetic fields M1 and M2 are produced by controllable electromagnets. However, additional permanent magnets may also be provided which produce a static magnetic field of such strength that the ferrites are operated above their gyromagnetic resonance where they show the least losses. The use of permanent magnets and electromagnets has the advantage that for tuning the ferrite loaded lines only small currents are required because, thanks to the permanent magnets, only a portion of the required magnetization must be generated by the electromagnets. It is also advantageous that, during a possible failure of the control current for the electromagnets, the leakage power in the ferrites does not rise very much, because the permanent magnets always maintain the magnetization of the ferrites above the gyromagnetic resonance.

We claim:

1. A tunable matching network for coupling to a microwave transmission line, comprising:

first and second transmission lines each having a first end and a second end, the first ends of the first and second transmission lines being connected together and the second ends of the first and second transmission lines each being adapted for coupling to a microwave transmission line, and at least one of the first and second transmission lines being loaded with ferrite material;

a third transmission line having one end coupled to and branching off from the first ends of the first and second transmission lines and being loaded with ferrite material; and means for generating and exposing the ferrite material of the first and second transmission lines and the ferrite material of the third transmission line to separate magnetic fields which are independently changeable for tuning the matching network.

2. The tunable matching network according to claim 1, wherein the first, second and third transmission lines are coaxial conductors each having an inner conductor and an outer conductor, and at least one of the inner conductor and the outer conductor of each of the first, second and third transmission lines are at least partially coated with the ferrite material.

3. The tunable matching network according to claim 1, wherein the first, second and third transmission lines are strip lines each having an inner conductor and an outer conductor, and at least one of the inner conductor and outer conductor of each of the first, second and third transmission lines are at least partially coated with the ferrite material.

4. The tunable matching network according to claim 1, wherein the first, second and third transmission lines each include an inner conductor and an outer conductor, the tunable matching network further comprising a cooling channel passing through at least one of the inner conductor and the outer conductor of each of the first, second and third transmission lines.

5. The tunable matching network according to claim 1, wherein the ferrite material is loaded on both the first and second transmission lines.

6. The tunable matching network according to claim 1, wherein at least one of the first and second magnetic fields include a permanent magnetic field component and a variable magnetic field component.

7. A tunable matching network for coupling to a microwave transmission line, comprising:

first and second transmission lines each having a first end and a second end, the first ends of the first and second transmission lines being connected together and the second ends of the first and second transmission lines each being adapted for coupling to a microwave transmission line, and at least one of the first and second transmission lines being loaded with ferrite material;

a third transmission line having one end coupled to and branching off from the first ends of the first and second transmission lines and being loaded with ferrite material; and means for generating and commonly exposing the ferrite material of the first and second transmission lines to a first magnetic field and for generating and exposing the ferrite material of the third transmission line to a second magnetic field, the first and second magnetic fields being separate and independently changeable for tuning the matching network.

* * * * *